United States Patent [19]

Zellweger

[11] 3,973,467

[45] Aug. 10, 1976

[54] CARTRIDGE INFEED APPARATUS FOR AN AUTOMATIC FIRING WEAPON

[75] Inventor: Jürg Zellweger, Neerach, Switzerland

[73] Assignee: Werkzeugmaschinenfabrik Oerlikon-Buhrle AG, Zurich, Switzerland

[22] Filed: May 9, 1975

[21] Appl. No.: 575,952

[30] Foreign Application Priority Data

May 16, 1974 Switzerland ..... 6707/74

[52] U.S. Cl. ..... 89/33 C

[51] Int. Cl.[2] ..... F41D 9/02

[58] Field of Search ..... 89/33 R, 33 BB, 33 C

[56] References Cited

UNITED STATES PATENTS 3,455,204 7/1969 Stoner ..... 89/33 C

*Primary Examiner*—Stephen C. Bentley

*Attorney, Agent, or Firm*—Werner W. Kleeman

[57] ABSTRACT

A cartridge infeed apparatus for an automatic firing weapon comprising a conveyor channel, one side wall of which possesses a slot which is essentially parallel to the axis of the weapon. Partially extending into this slot is a cartridge located in the conveyor channel and which cartridge is to be inserted by the breechblock of the weapon into the weapon barrel. There are further provided two pivotable guide arms which, under the action of spring means, press the cartridge towards the aforementioned slot perpendicular to the direction of conveying of such cartridge. At the side of the guide arms opposite the cartridge there is arranged a pivotable pawl mechanism at which there is present a cam with control surfaces, said cam serving to actuate the pawl mechanism and bearing at a further cartridge located in the cartridge conveying direction behind the first-mentioned cartridge. The pawl mechanism can be rocked out of a work position, in which it is positioned behind the guide arms during the insertion of the cartridge, into a rest position in which the guide arms are rocked against the force of the spring means.

2 Claims, 4 Drawing Figures

CARTRIDGE INFEED APPARATUS FOR AN AUTOMATIC FIRING WEAPON

BACKGROUND OF THE INVENTION

The present invention relates to a new and improved construction of cartridge infeed or delivery apparatus at an automatic firing weapon for infeeding cartridges comprising a conveyor channel, one side wall of which possesses a slot which extends essentially parallel to the weapon axis, a cartridge located in the conveyor channel and which cartridge is to be inserted by the breechblock of the weapon into the weapon barrel partially extends into such slot, there further being provided two pivotable guide arms which, by the action of spring means, press such cartridge perpendicular to the direction of conveying of the cartridges against the aforementioned slot.

According to a state-of-the-art cartridge infeed mechanism of this type, as disclosed for instance in U.S. Pat. No. 3,455,204, the cartridges are displaced through such an extent in the conveyor channel until the first cartridge partially extends into the aforementioned slot, pivotable spring-loaded guide arms resiliently fixedly retaining such first cartridge in this slot. The breechblock, which extends through the aforesaid slot and eccentrically bears against the base or rear end of the cartridge, thereafter pushes such cartridge into the weapon barrel. Since the cartridge is located at an inclination with respect to the direction of movement of the breechblock the inertia force which arises upon acceleration of the cartridge produces a force component directed transversely with respect to the weapon axis and which strives to press the cartridge away from the breechblock. There then exists the danger that the cartridge will slide-off the breechblock, move forwardly adjacent the breechblock and will become clamped or bind, instead of being successfully pushed into the weapon barrel.

Furthermore, there is known in this art a cartridge infeed mechanism of the aforementioned general type, as taught in U.S. Pat. No. 3,080,793, wherein the guide arms secure the cartridge which protrudes into the aforementioned slot only against a displacement in the direction of the conveyor channel. The aforementioned problems are not eliminated with this prior art mechanism.

SUMMARY OF THE INVENTION

Hence, it is a primary object of the present invention to provide an improved cartridge infeed apparatus for an automatic firing weapon which is not associated with the aforementioned drawbacks and limitations of the prior art proposals.

Another and more specific object of the present invention aims at the provision of a cartridge infeed apparatus wherein there is reliably avoided sliding-off of the cartridge from the breechblock.

Now in order to implement these and still further objects of the invention, which will become more readily apparent as the description proceeds, the apparatus of the invention is manifested by the features that at the side of the guide arms opposite the cartridge there is arranged a pivotable pawl mechanism at which there is provided a cam with control surfaces. This cam serves to actuate the pawl mechanism and bears at a further cartridge located in the conveying direction behind the first-mentioned cartridge. The pawl mechanism can be rocked or pivoted out of a work position, in which it is positioned behind the guide arms during the insertion of the cartridge, into a rest position in which the guide arms are rocked against the force of the spring means.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
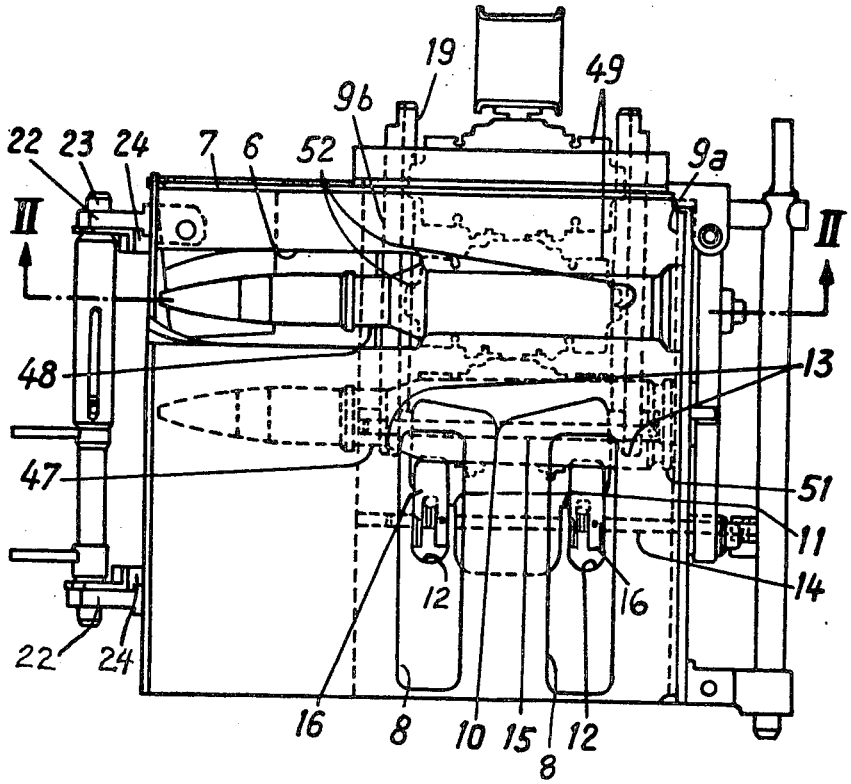
FIG. 1 is a side view of a conveyor channel for an ammunition belt according to the invention and looking in the direction of the arrow F of FIG. 1.
Figure 2:
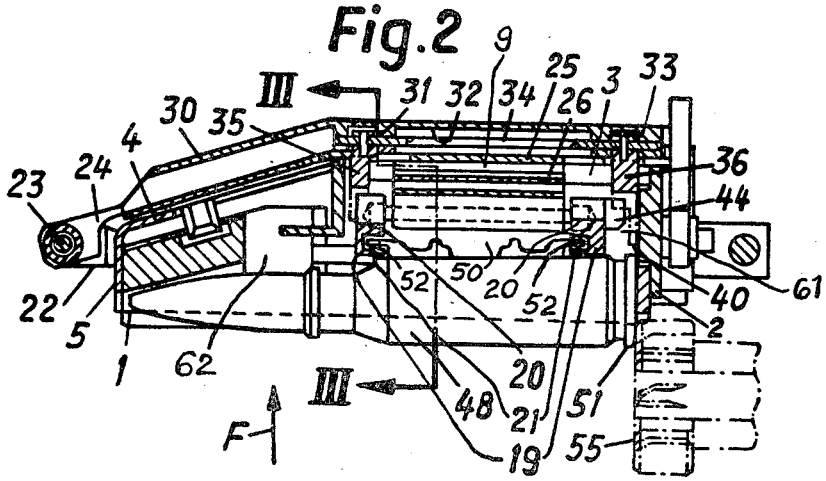
FIG. 2 is a sectional view taken substantially along the line II—II of FIG. 1.

Describing now the drawings, according to the showing of FIGS. 1 and 2, the cross-section of a conveyor channel 50 which is bounded by the walls 1, 2, 3, 4 and 5 has a first portion 61 (FIG. 2) of substantially rectangular configuration defined by part of the side wall 1 and the further walls 2 and 3 and at one end thereof there merges a substantially trapezoidal-shaped portion 62 defined by a further part of side wall 1 and the walls 4 and 5. In the side wall 1 there is provided an essentially rectangular slot 6 which extends essentially in parallelism with the upper end surface or edge 7 of the conveyor channel 50. Furthermore, side wall 1 possesses two slots 8 directed substantially perpendicular to the axially extending cartridge outfeed or discharge slot 6, as best seen by referring to FIG. 1.

Figure 3:
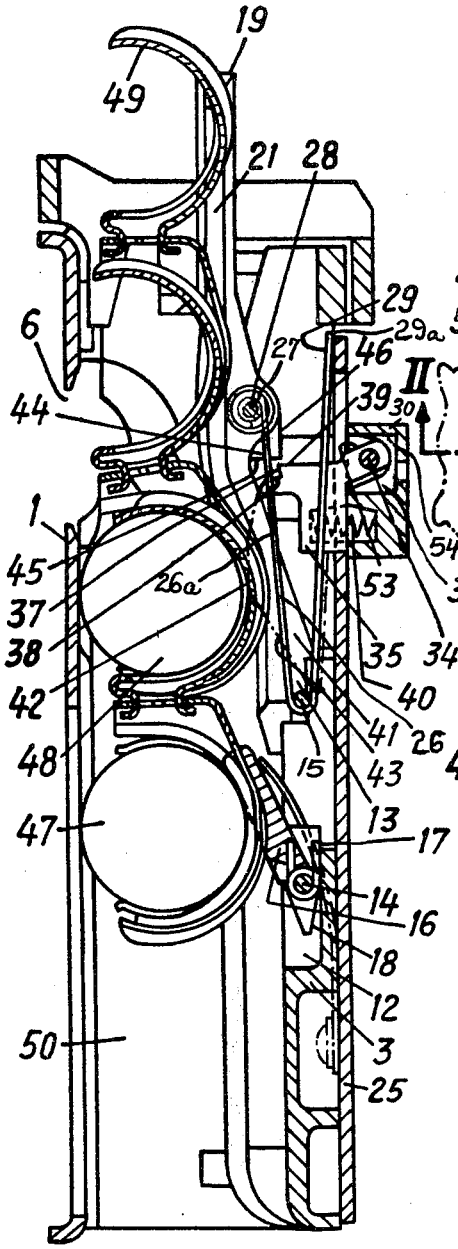
FIGS. 3 and 4 are respective sectional views taken substantially along the line III—III of FIG. 2 showing different positions of the cartridges.
Figure 4:
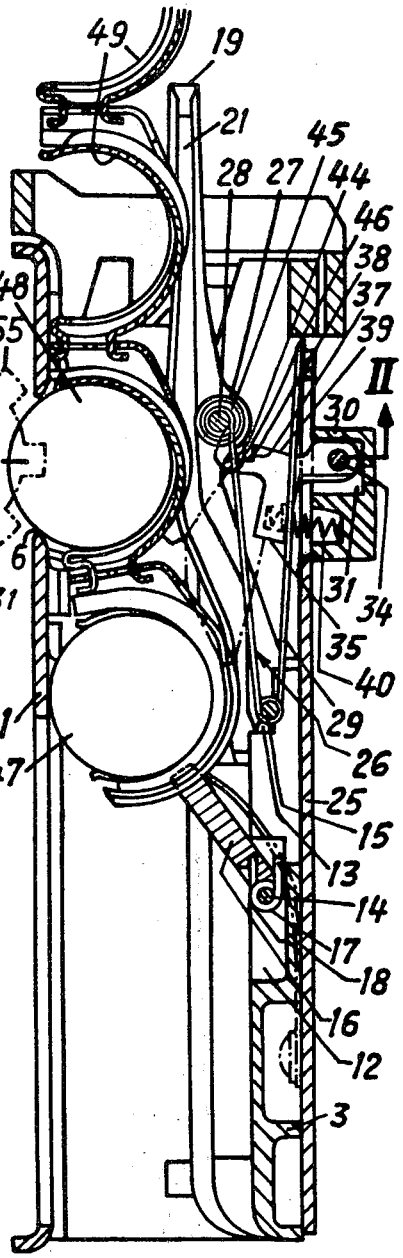

The wall 3 has a recess or opening 9 (FIG. 2) which extends downwardly away from the upper edge 7, the lateral or side boundaries 9a, 9b (FIG. 1) of which are essentially parallel to the vertical lengthwise axis of the conveyor channel 50. This recess or opening 9 tapers or narrows in the lower part thereof in a step-shaped manner symmetrically to its lengthwise axis. In all four steps 10, 11 there are machined or otherwise formed the grooves 12, 13. Through both of the pairs of grooves 12, 13 there are introduced the shafts or axles 14, 15 which are secured in the wall 3, as best seen by referring to FIGS. 3 and 4. In the grooves 12 there are rotatably mounted the ends of pawls or pawl members 16 upon the shaft 14. The pawls 16 are loaded or biased by spiral springs 17 or equivalent structure and bear under the action of such springs 17 with a surface 18 at the channel wall 3. These pawls 16 extend at an inclination upwardly into the channel 50. The ends of two guide arms 19 are pivotably mounted at the shaft or axle 15 in the grooves 13. At the location of the confronting surfaces 20 of these movable guide arms 19 there are cut-out or otherwise suitably formed approximately rectangular-shaped grooves 21 in such guide arms 19. These guide arms 19 are furthermore flexed or angled and extend upwardly out of the channel, as shown in FIGS. 3 and 4.

As clearly recognized from the showing of FIG. 1, two supports 22 are connected with the channel wall 5 and in these supports there is secured a shaft or axle 23. Two hinges or pivot means 24 are rotatably mounted upon the shaft 23. The hinges 24 are connected with an angled or flexed plate or plate member 25 (see FIGS. 2 to 4). This plate 25 forms a cover member or cover for the channel wall 3. A substantially V-shaped blade or leaf spring 26 is suspended with its flexed end 27 of its one leg 26*a* at a rod 28 mounted in both guide arms 19 and is guided with its tip about the shaft or axle 15. The end 29*a* of the spring leg 29 bears against plate 25.

A substantially rectangular prismatic support body 30 is secured to the outside of the plate 25. This support 30 possesses three grooves 31, 32, 33 having a substantially rectangular bottom or base. A shaft 34 which is substantially parallel to the plate 25 is mounted in the support body or support 30. Keyed or otherwise appropriately connected to the shaft 34 are two pawls or pawl members 35, 36. As shown in FIG. 2 these pawls 35, 36 extend into the belted cartridge conveyor channel 50 and each respectively possess two surfaces 37, 38 (FIGS. 3 and 4) directed essentially perpendicular to one another as well as an end surface 39. The pawl 36 is subjected to the pressure of a spring 40 (FIGS. 3 and 4) bearing at the support 30 and has a cam 41 with two control surfaces 42, 43. The guide arms 19 are each provided beneath the mounting or bearing locations for the rod 28 with a projection 44 having a surface 45 which is directed perpendicular to the channel axis and with a surface 46 which is parallel to the channel wall.

The mode of operation of the apparatus will be apparent from the above-described construction and is as follows:

According to the showing of FIG. 3 a belt section 70 composed of two cartridges 47, 48 and two empty belt elements 49 is located in the cartridge conveyor channel 50. The belt elements 49 possess two flaps or tongues 52 which engage in the grooves 21 of the guide arms 19. The belt section 60 is moved upwardly by means of not particularly illustrated conventional conveyor pawls or equivalent structure engaging at the cartridge 47. The cartridge 47 has rocked the retaining pawls 16, which now bear at it, in the clockwise direction (viewed with respect to the showing of FIG. 3) about the shaft or axle 14. The cartridge 48, during the upward movement, is pushed with its rear end or base 51 against the cam surface 42 of the pawl 36 and thus has rocked such, and therefore also the shaft 34 with the pawl 35 (viewed in the direction of the showing of FIG. 3) in the counterclockwise direction. Due to the pivoting or rocking of the pawls 35, 36 their surfaces 39 have moved below the surface 45 of the guide arm projection 44. During the further movement of the cartridge 48 the flaps or tongues 52 of its belt element 49 no longer move in the part of the grooves 21 of the guide arms 19 which are parallel to the channel axis, rather in their portion which extends at an inclination upwardly towards the center of the channel. Since the cartridge 48 still slides along the channel wall 1 the arms 19 are rocked against the pressure of the spring 26 in the clockwise direction about the shaft 15, with the result that the surfaces 45 of the projections 44 of the arms 19 move without obstruction over the surfaces 39 of the pawls 35, 36.

When the cartridge 48 has arrived at the height of the cartridge ejection or outfeed opening or slot 6 in the channel wall 1, then it is moved towards such and partially into such into the disengaging position. This movement is associated with a pivoting movement of the guide arms 19 which carry out such under the action of the spring 26 in the counterclockwise direction (viewed with the regard to the showing of FIG. 4) about the shaft 15. During the movement of the cartridge 48 towards the disengaging position its base 51 moves away from the cam 41 of the pawl 36. The pawl 36 thus can again rock back under the pressure of its spring 40, in the counterclockwise direction about the shaft 15, into the rest position illustrated in FIG. 4 in which its surface 53 impacts against the surface 54 of the groove 33 acting as a stop or impact means. By means of the pawl 36 the shaft 34, and thus also the pawl 35, are pivoted or rocked, so that their surfaces 38 bear at the surfaces 45 of the projections 44 of the arms 19. At the same time the pawl surfaces 37 arrive behind the surfaces 46 of the arms 19 and furthermore the retaining pawls 16 are positioned behind the cartridge 47.

According to the showing of FIGS. 2 and 4, the head of the breechblock 55 of a not particularly further illustrated firing weapon, of which the conveyor channel 50 forms a part, during its forward movement or advance eccentrically impacts against the cartridge rear end or base 51. The pair of forces which are formed by the impact force of the breechblock 55 and the inertia force acting in the lengthwise axis of the cartridge 48, strive to rotate the cartridge about its vertical axis out of the path of the breechblock 55. The rotation of such cartridge is however prevented by the positioning of the pawls 35, 36 behind the arms 19 guiding its belt element 49.

While there is shown and described present preferred embodiments of the invention, it is to be distinctly understood that the invention is not limited thereto, but may be otherwise variously embodied and practiced within the scope of the following claims. Accordingly,

What is claimed is:

1. A cartridge infeed apparatus at an automatic firing weapon, comprising a conveyor channel, said conveyor channel having a side wall possessing a slot extending substantially parallel to the axis of the weapon, the weapon having a breechblock, a number of cartridges located in the conveyor channel wherein each cartridge leading in the direction of conveying of the cartridges is intended to be inserted by the breechblock into the weapon barrel, said leading cartridge partially extending into said slot, a pair of pivotably mounted guide arms, spring means acting at said guide arms for causing the guide arms through the action of the spring means to press the leading cartridge in a direction substantially perpendicular to the conveying direction against said slot, pivotable pawl means arranged at the side of the guide arms opposite the cartridge, cam means provided with control surfaces provided for the pivotable pawl means, said cam means serving to actuate said pawl means and bearing upon a further cartridge located in the conveying direction behind the leading cartridge, and wherein the pawl means can be pivoted out of a work position in which said pawl means is positioned behind the guide arms during the insertion of the cartridge into a rest position in which the guide arms are rocked against the force of the spring means.

2. The cartridge infeed apparatus as defined in claim 1, wherein said pawl means is held in said work position by the force of a spring, said spring striving to press the cam means with the control surfaces against said further cartridge.

* * * * *